US007927106B1

(12) United States Patent
Butscher et al.

(10) Patent No.: US 7,927,106 B1
(45) Date of Patent: Apr. 19, 2011

(54) CYLINDRICAL SLIP RING SYSTEM

(75) Inventors: Stephen T. Butscher, Riverside, CA (US); Joseph E. Justin, Corona, CA (US)

(73) Assignee: The Boeing Company, Chicago, IL (US)

( * ) Notice: Subject to any disclaimer, the term of this patent is extended or adjusted under 35 U.S.C. 154(b) by 46 days.

(21) Appl. No.: 12/566,920

(22) Filed: Sep. 25, 2009

(51) Int. Cl.
*H01R 39/00* (2006.01)

(52) U.S. Cl. ..... 439/28

(58) Field of Classification Search ..... 439/6, 11, 439/13, 18, 20, 21–29
See application file for complete search history.

(56) References Cited

U.S. PATENT DOCUMENTS

| | | | | |
|---|---|---|---|---|
| 4,444,459 | A | 4/1984 | Woodwell | |
| RE34,693 | E | 8/1994 | Plocek et al. | |
| 6,048,211 | A * | 4/2000 | Liaom | 439/4 |
| 6,196,851 | B1 * | 3/2001 | Gerard et al. | 439/21 |
| 6,633,266 | B2 | 10/2003 | Blen et al. | |
| 6,921,269 | B2 * | 7/2005 | Johnson et al. | 439/13 |
| 7,094,059 | B2 * | 8/2006 | Obermeyer | 439/6 |
| 7,131,844 | B1 * | 11/2006 | Wurr | 439/20 |
| 2005/0026462 | A1 * | 2/2005 | Johnson et al. | 439/13 |
| 2005/0279885 | A1 | 12/2005 | Tebon | |
| 2010/0079766 | A1 * | 4/2010 | Justin | 356/465 |

OTHER PUBLICATIONS

USPTO Notice of Allowance for U.S. Appl. No. 12/573,274 dated Oct. 7, 2010.
U.S. Appl. No. 12/573,274, filed Oct. 5, 2009, Justin et al.

* cited by examiner

*Primary Examiner* — Ross N Gushi
(74) *Attorney, Agent, or Firm* — Yee & Associates, P.C.; James M. Poole

(57) ABSTRACT

A method and apparatus for transmitting signals. An apparatus comprises a first cylinder, a second cylinder, a third cylinder, and a fourth cylinder. A first cylinder has a first number of conductive segments. The second cylinder has a second number of conductive segments. The first cylinder is located inside the second cylinder such that the first conductive segments remain in communication with corresponding ones of the second conductive segments during rotation of the first and second cylinders relative to each other. The third cylinder has a third number of conductive segments. The second cylinder is located inside of the third cylinder. The fourth cylinder has a fourth number of conductive segments. The third cylinder is located inside the fourth cylinder such that the third conductive segments remain in communication with corresponding ones of the fourth conductive segments during rotation of the third and fourth cylinders.

21 Claims, 12 Drawing Sheets

CYLINDRICAL SLIP RING SYSTEM

BACKGROUND INFORMATION

1. Field

The present disclosure relates generally to platforms with rotating structures and, in particular, to a method and apparatus for transferring signals between a rotating structure and a non-rotating structure.

2. Background

Many types of platforms have structures that rotate relative to each other. These types of structures are found in various platforms, such as unmanned aircraft, manned aircraft, missiles, spacecraft, miniature robotics, ships, satellites, space stations, and other types of platforms.

With these types of platforms, signals may be transmitted between a rotating structure and a non-rotating structure on the platform. These signals may take the form of power and/or data. The signals may be optical and/or electrical. For example, a satellite may have a dish antenna. The dish antenna may be maintained in a stationary position relative to the earth, while the satellite may rotate. As another example, a robot may have a robotic arm that rotates.

Various mechanisms are used to provide connections to send signals between these types of structures. For example, slip rings, pre-twisted wire bundles, flexible tape cables, and mercury-filled rotary devices have been used to transmit signals between a rotating structure and a non-rotating structure.

With aircraft, spacecraft, and other similar vehicles, the size, shape, and weight of these types of structures may influence the performance of the vehicles. Reductions in the size of various structures are desirable because the reductions may result in decreased weight and volume. Additionally, these reductions also may provide a capability to reduce the number of structural components needed to support a rotating structure and a non-rotating structure with respect to each other. The reductions in structures may occur as the size of various devices and electronics in a platform decrease.

Many of the currently available mechanisms for transmitting signals between these types of structures, however, do not provide the desired amount of rotation. Further, as these structures decrease in size, mechanisms, such as flexible tape cables, rotary joints, pre-twisted wire bundles, and mercury-filled rotary devices may limit the design of structures because of the space requirements for these devices.

Therefore, it would be advantageous to have a method and apparatus that takes into account at least some of the issues discussed above, as well as possibly other issues.

SUMMARY

In one advantageous embodiment, an apparatus comprises a first cylinder, a second cylinder, a third cylinder, and a fourth cylinder. The first cylinder has a first number of conductive segments located on an outer surface of the first cylinder. The first number of conductive segments is configured to conduct first signals, and the first cylinder has an axis of rotation extending through the first cylinder. The second cylinder has a second number of conductive segments located on an inner surface of the second cylinder. The second number of conductive segments is configured to conduct the first signals. The second cylinder has the axis of rotation. The first cylinder is located inside the second cylinder such that the first number of conductive segments remains in communication with corresponding ones of the second number of conductive segments during rotation of the first cylinder and the second cylinder relative to each other. The third cylinder has a third number of conductive segments located on an outer surface of the third cylinder. The third number of conductive segments is configured to conduct second signals. The third cylinder has the axis of rotation extending through the third cylinder. The second cylinder is located inside of the third cylinder. The fourth cylinder has a fourth number of conductive segments located on an inner surface of the fourth cylinder. The fourth number of conductive segments is configured to conduct the second signals. The fourth cylinder has the axis of rotation. The third cylinder is located inside the fourth cylinder such that the third number of conductive segments remains in communication with corresponding ones of the fourth number of conductive segments during rotation of the third cylinder and the fourth cylinder relative to each other.

In another advantageous embodiment, an electrical signal connector system comprises a first cylinder, a second cylinder, a third cylinder, and a fourth cylinder. The first cylinder has a first number of conductive segments located on an outer surface of the first cylinder and a first number of connectors electrically connected to the first number of conductive segments. The first number of connectors is located on an end of the first cylinder, and the first number of conductive segments is configured to conduct first electrical signals. The second cylinder has a second number of conductive segments located on an inner surface of the second cylinder and a second number of connectors electrically connected to the second number of conductive segments. The second number of connectors is located on an end of the second cylinder. The second number of conductive segments is configured to conduct the first electrical signals. The first cylinder is located inside and concentric to the second cylinder such that corresponding ones of the first number of conductive segments remain in electrical contact with corresponding ones of the second number of conductive segments during rotation of the first cylinder and the second cylinder relative to each other. The third cylinder has a third number of conductive segments located on an outer surface of the third cylinder and a third number of connectors electrically connected to the third number of conductive segments. The third number of connectors is located on an end of the third cylinder. The third number of conductive segments is configured to conduct second electrical signals, and the second cylinder is located inside and concentric to the third cylinder. The fourth cylinder has a fourth number of conductive segments located on an inner surface of the fourth cylinder and a fourth number of connectors electrically connected to the fourth number of conductive segments. The fourth number of connectors is located on an end of the fourth cylinder, and the fourth number of conductive segments is configured to conduct the second electrical signals. The third cylinder is located inside and concentric to the fourth cylinder such that corresponding ones of the third number of conductive segments remain in electrical contact with corresponding ones of the fourth number of conductive segments during rotation of the third cylinder and the fourth cylinder relative to each other.

In yet another advantageous embodiment, a method is present for transmitting signals. The signals are sent from a first structure in a platform into a cylindrical slip ring system comprising a first cylinder having a first number of conductive segments located on an outer surface of the first cylinder. The first number of conductive segments is configured to conduct first signals, and the first cylinder has an axis of rotation extending through the first cylinder. A second cylinder having a second number of conductive segments is located on an inner surface of the second cylinder. The second number of conductive segments is configured to conduct the first signals. The second cylinder has the axis of rotation. The first cylinder is located inside the second cylinder such that the first number of conductive segments remains in communication with corresponding ones of the second number of conductive segments during rotation of the first cylinder and the second cylinder relative to each other. A third cylinder having a third number of conductive segments is located on an outer surface of the third cylinder. The third number of conductive segments is configured to conduct second signals. The third cylinder has the axis of rotation extending through the third cylinder. The second cylinder is located inside of the third cylinder. A fourth cylinder having a fourth number of conductive segments is located on an inner surface of the fourth cylinder. The fourth number of conductive segments is configured to conduct the second signals. The fourth cylinder has the axis of rotation. The third cylinder is located inside the fourth cylinder such that the third number of conductive segments remains in communication with corresponding ones of the fourth number of conductive segments during rotation of the third cylinder and the fourth cylinder relative to each other. The first signals are sent to a second structure in communication with the cylindrical slip ring system in response to receiving the first signals from the first structure at the cylindrical slip ring system.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

Figure 1:
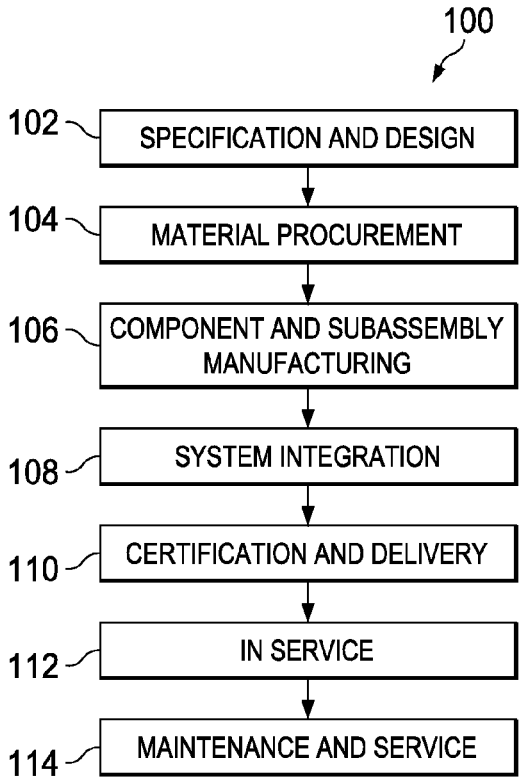
FIG. 1 is an illustration of a spacecraft manufacturing and service method in accordance with an advantageous embodiment.
Figure 2:
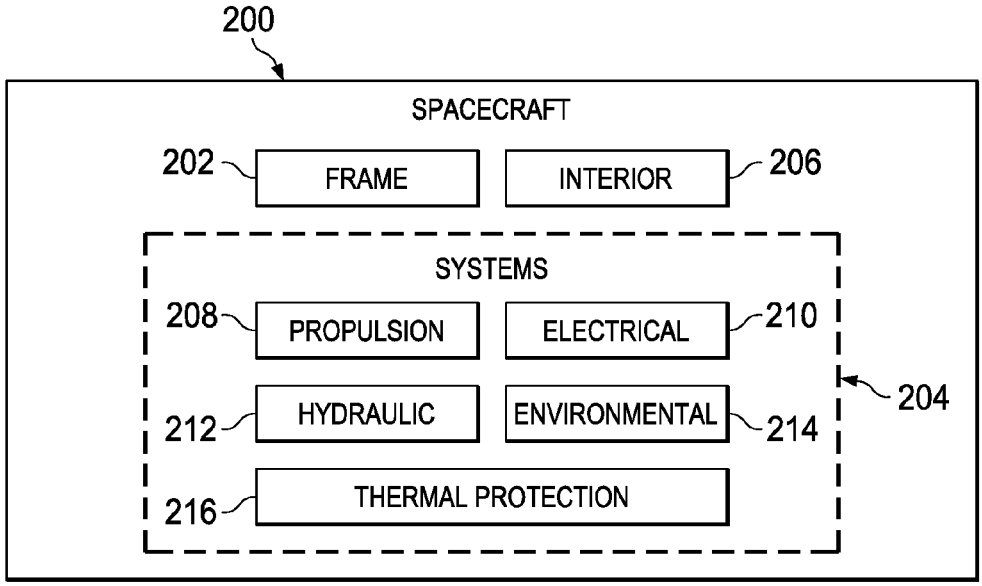
FIG. 2 is an illustration of a spacecraft in which an advantageous embodiment may be implemented.

Referring more particularly to the drawings, embodiments of the disclosure may be described in the context of spacecraft manufacturing and service method 100 as shown in FIG. 1 and spacecraft 200 as shown in FIG. 2. Turning first to FIG. 1, an illustration of a spacecraft manufacturing and service method is depicted in accordance with an advantageous embodiment. During pre-production, spacecraft manufacturing and service method 100 may include specification and design 102 of spacecraft 200 in FIG. 2 and material procurement 104.

During production, component and subassembly manufacturing 106 and system integration 108 of spacecraft 200 in FIG. 2 takes place. Thereafter, spacecraft 200 in FIG. 2 may go through certification and delivery 110 in order to be placed in service 112. While in service 112 by a customer, spacecraft 200 in FIG. 2 is scheduled for routine maintenance and service 114, which may include modification, reconfiguration, refurbishment, and other maintenance or service.

Each of the processes of spacecraft manufacturing and service method 100 may be performed or carried out by a system integrator, a third party, and/or an operator. In these examples, the operator may be a customer. For the purposes of this description, a system integrator may include, without limitation, any number of spacecraft manufacturers and major-system subcontractors; a third party may include, without limitation, any number of vendors, subcontractors, and suppliers; and an operator may be a company, a military entity, a service organization, and so on.

With reference now to FIG. 2, an illustration of a spacecraft is depicted in which an advantageous embodiment may be implemented. In this illustrative example, spacecraft 200 is produced by spacecraft manufacturing and service method 100 in FIG. 1. Spacecraft 200 may include frame 202 with a plurality of systems 204 and interior 206.

Examples of the plurality of systems 204 include one or more of propulsion system 208, electrical system 210, hydraulic system 212, environmental system 214, and thermal protection system 216. Although an aerospace example is shown, different advantageous embodiments may be applied to other industries, such as the automotive industry.

Apparatus and methods embodied herein may be employed during at least one of the stages of spacecraft manufacturing and service method 100 in FIG. 1. As used herein, the phrase "at least one of", when used with a list of items, means that different combinations of one or more of the listed items may be used and only one of each item in the list may be needed. For example, "at least one of item A, item B, and item C" may include, for example, without limitation, item A, or item A and item B. This example also may include item A, item B, and item C, or item B and item C.

In one illustrative example, components or subassemblies produced in component and subassembly manufacturing 106 in FIG. 1 may be fabricated or manufactured in a manner similar to components or subassemblies produced while spacecraft 200 is in service 112 in FIG. 1. As yet another example, number of apparatus embodiments, method embodiments, or a combination thereof may be utilized during production stages, such as component and subassembly manufacturing 106 and system integration 108 in FIG. 1.

A number, when referring to items, means one or more items. For example, a number of apparatus embodiments are one or more apparatus embodiments. A number of apparatus embodiments, method embodiments, or a combination thereof may be utilized while spacecraft 200 is in service 112 and/or during maintenance and service 114 in FIG. 1. The use of a number of the different advantageous embodiments may substantially expedite the assembly of and/or reduce the cost of spacecraft 200.

The different advantageous embodiments recognize and take into account a number of different considerations. For example, the different advantageous embodiments recognize and take into account that currently available mechanisms for providing transmission signals between a rotating structure and a non-rotating structure with the desired amount of rotation may not have as small a size as desired.

For example, the different advantageous embodiments recognize and take into account that current slip ring systems may be used to transfer signals between a rotating structure and a non-rotating structure. These slip ring systems include drum slip ring systems and plate slip ring systems. A drum slip ring system has cylinders, in which rings of segments are arranged in a cylindrical fashion alternating between insulating and conductive segments in the cylinder. A plate slip ring system has rings of conductors alternating with insulators in a single plane. The diameter of each ring increases in size as the ring is farther away from the center.

With a cylindrical slip ring system, the number of conductors is directly proportional to the overall length of the cylinder. Thus, the different advantageous embodiments recognize and take into account that as the number of conductors increase, the cylinder becomes longer with respect to the diameter. This constraint can affect the size of a cylindrical slip ring system. For example, a thicker component than desired may be needed to accommodate the length of the cylindrical slip ring system.

The different advantageous embodiments recognize and take into account that a plate slip ring system solves a length problem. The system also may be referred to as a pancake slip ring system. In contrast, this type of device increases in diameter. Further, although the thickness or length may be smaller as compared to a drum slip ring assembly, room is still needed for connectors, such as brushes and wires. As a result, the size of this type of structure may not be as small as desired. Further, a plate-type design may not be suitable for the amount of shock or vibrations that may be encountered in some environments.

Thus, the different advantageous embodiments employ two cylindrical slip rings oriented in a concentric manner such that a smaller cylindrical slip ring is integrated in a larger one. For example, in one advantageous embodiment, an apparatus comprises a first cylinder, a second cylinder, a third cylinder, and a fourth cylinder. The first cylinder has a first number of conductive segments located on an outer surface of the first cylinder. The first number of conductive segments is configured to conduct first signals, and the first cylinder has an axis of rotation extending through the first cylinder.

The second cylinder has a second number of conductive segments located on an inner surface of the second cylinder. The second number of conductive segments is configured to conduct the first signals. The second cylinder also has the axis of rotation. The first cylinder is located inside of the second cylinder such that corresponding ones of the first number of conductive segments remain in communication with corresponding ones of the second number of conductive segments during rotation of the first cylinder and the second cylinder relative to each other.

The first cylinder and the second cylinder are located inside of the third cylinder. The third cylinder has a third number of conductive segments located on an outer surface of the third cylinder. The third number of conductive segments is configured to conduct second signals, and the third cylinder has the axis of rotation extending through the third cylinder. The fourth cylinder has a fourth number of conductive segments located on an inner surface of the fourth cylinder. The fourth number of conductive segments is configured to conduct the second signals. The fourth cylinder also has the axis of rotation. The third cylinder is located inside of the fourth cylinder, such that corresponding ones of the third number of conductive segments remain in communication with the fourth number of connectors during rotation of the third cylinder and the fourth cylinder relative to each other.

Figure 3:
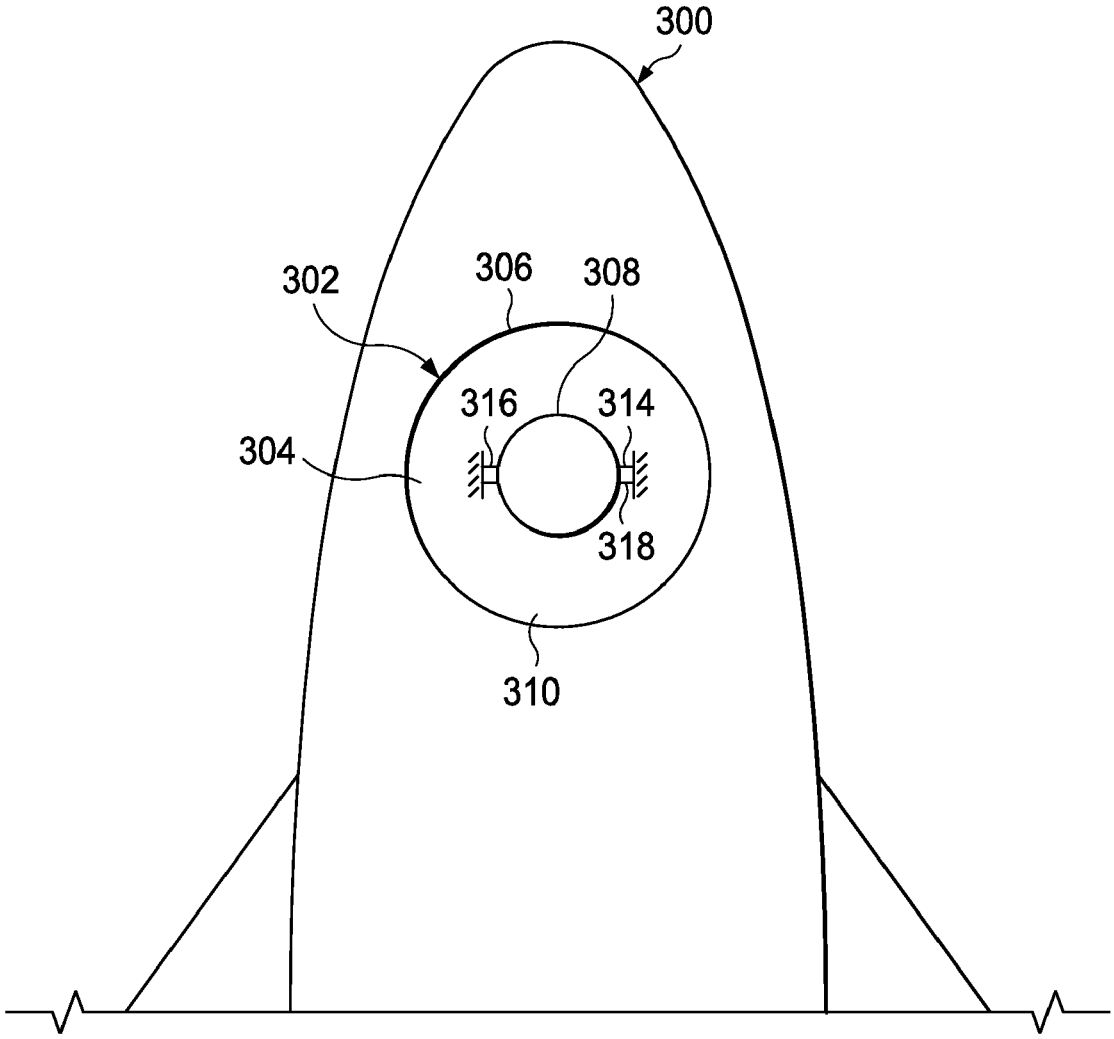
FIG. 3 is an illustration of one implementation for a spacecraft in accordance with an advantageous embodiment.

With reference now to FIG. 3, an illustration of a spacecraft is depicted in accordance with an advantageous embodiment. In this illustrative example, spacecraft 300 is an example of one implementation for spacecraft 200 in FIG. 2.

In this depicted example, spacecraft 300 may carry payload 302. Payload 302 is satellite 304 in this particular example. Satellite 304 has rotating structure 306 and stationary structure 308. Rotating structure 306, in this example, takes the form of inertial measurement unit 310.

Rotating structure 306 is associated with stationary structure 308 through joints, such as joint 314 and joint 316. In this illustrative example, cylindrical slip ring system 318 is associated with joint 314. Cylindrical slip ring system 318 provides a capability to transfer signals between rotating structure 306 and stationary structure 308.

The illustration of spacecraft 300 with payload 302 in FIG. 3 is not meant to imply physical or architectural limitations to the manner in which other advantageous embodiments may be implemented. Other components in addition to and/or in place of the ones illustrated may be used. Some components may be unnecessary in some advantageous embodiments.

For example, in some advantageous embodiments, rotating structure 306 may be part of spacecraft 300 rather than payload 302. Additionally, inertial measurement unit 310 may be located in spacecraft 300. Further, in other advantageous embodiments, additional joints, in addition to joints 314 and 316, may be present. Joints, in addition to joints 314 and 316, may be present for inertial measurement unit 310 to allow a desired amount of rotation of additional axes.

In yet other advantageous embodiments, additional cylindrical slip ring systems may be present in addition to cylindrical slip ring system 318. For example, cylindrical slip ring system 318 also may be implemented in joint 316.

Figure 4:
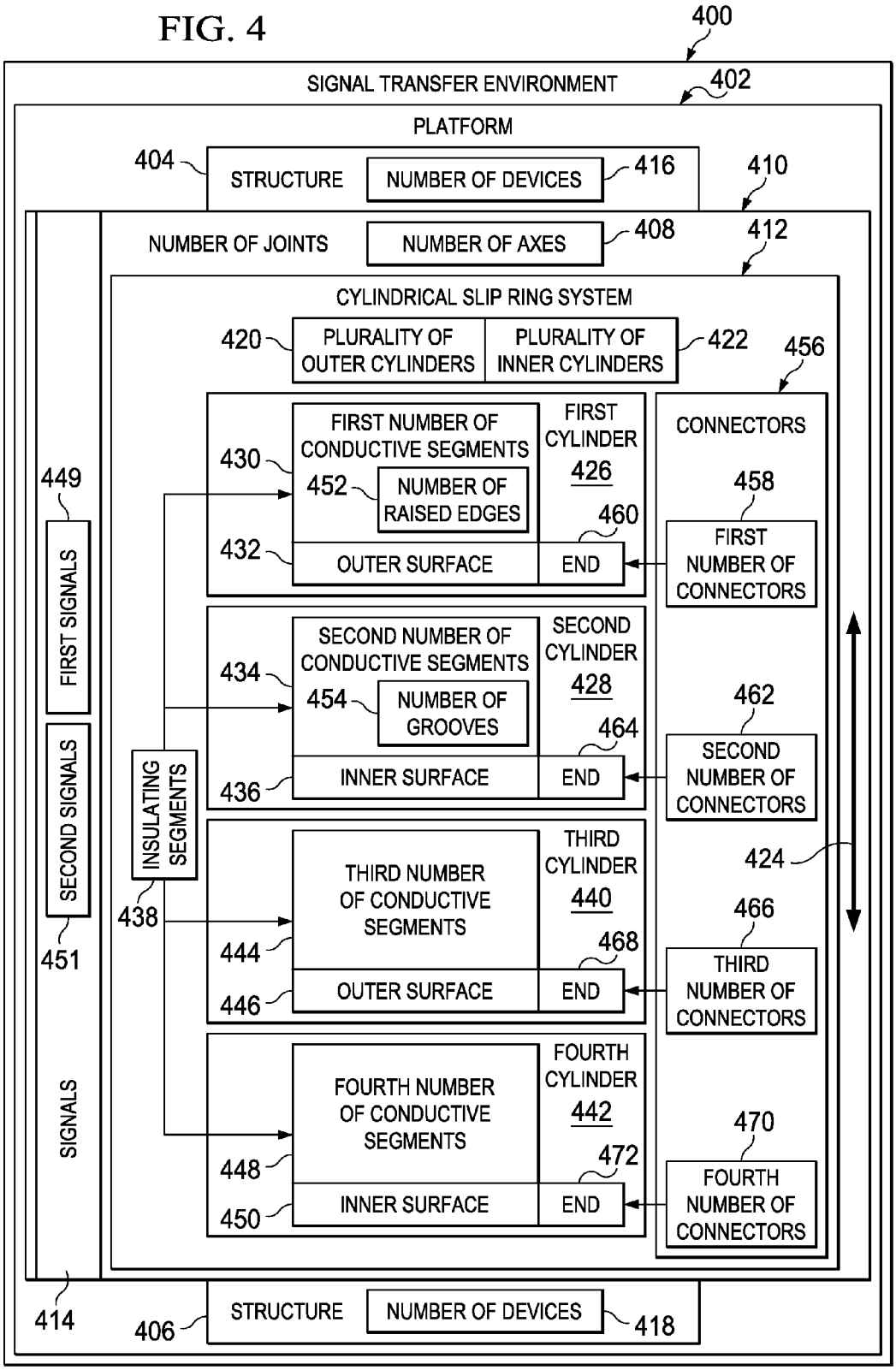
FIG. 4 is an illustration of a signal transfer environment in accordance with an advantageous embodiment.

With reference now to FIG. 4, an illustration of a signal transfer environment is depicted in accordance with an advantageous embodiment. Signal transfer environment 400 may be implemented using platform 402. Platform 402 may be, for example, spacecraft 200 in FIG. 2 or spacecraft 300 in FIG. 3.

Platform 402 has structure 404 and structure 406. In these illustrative examples, structure 404 and structure 406 may rotate relative to each other on number of axes 408. Structure 404 may be stationary, while structure 406 rotates. In some advantageous embodiments, both structure 404 and structure 406 may rotate.

In these illustrative examples, structure 404 and structure 406 are connected to each other using number of joints 410. Depending on the joints present in number of joints 410 and their configuration, different number of axes 408 may be present. In some advantageous embodiments, number of axes 408 may be one axis, while in other advantageous embodiments, two or three axes may be present. Of course, the axes within number of axes 408 may vary, depending on the particular embodiment.

One or more of number of joints 410 includes cylindrical slip ring system 412. Cylindrical slip ring system 412 facilitates the communication of signals 414 between structures 404 and 406. A communication of signals 414 means that signals 414 may be transferred from structure 404 to structure 406 and/or from structure 406 to structure 404.

This exchange of signals 414 may occur while structure 404 and structure 406 rotate relative to each other. The rotation of structure 404 and structure 406 relative to each other means one or both of these structures may rotate. For example, both structure 404 and structure 406 may rotate relative to each other, or structure 404 may be stationary while structure 406 rotates.

Signals 414 may take various forms. For example, signals 414 may be electrical and/or optical signals. Further, signals 414 may carry data or supply power. In these examples, signals 414 may be transferred between number of devices 416 in structure 404 and number of devices 418 in structure 406.

As illustrated, cylindrical slip ring system 412 includes plurality of outer cylinders 420 and plurality of inner cylinders 422. Each cylinder within plurality of outer cylinders 420 is located concentrically with each other and plurality of inner cylinders 422 about axis of rotation 424.

In other words, plurality of outer cylinders 420 and plurality of inner cylinders 422 all rotate about axis of rotation 424. Axis of rotation 424 is an axis through the center portion of each of plurality of outer cylinders 420 and plurality of inner cylinders 422. Plurality of outer cylinders 420 alternates with plurality of inner cylinders 422 in these examples.

In these illustrative examples, first cylinder 426 is an example of an inner cylinder. Second cylinder 428 is an example of an outer cylinder. First cylinder 426 has axis of rotation 424 extending through first cylinder 426. Axis of rotation 424 also extends through second cylinder 428. First cylinder 426 is located inside of second cylinder 428.

As depicted, first cylinder 426 has first number of conductive segments 430 located on outer surface 432 of first cylinder 426. Second number of conductive segments 434 is located on inner surface 436 of second cylinder 428.

The arrangement of these conductive segments are such that first number of conductive segments 430 remain in communication with corresponding ones of second number of conductive segments 434 during rotation of first cylinder 426 and second cylinder 428. In other words, one corresponding segment remains in communication with another corresponding segment for both cylinders. In these illustrative examples, this communication may be provided using an electrical connection or an optical connection, depending on the particular implementation. A segment is in communication with another segment when a signal can be transferred between the two segments. The signal may be an electrical, optical, and/or other suitable type of signal in these examples.

Additionally, in these illustrative examples, insulating segments 438 are interspersed between first number of conductive segments 430 and second number of conductive segments 434. Insulating segments 438 are placed such that conductive segments in first number of conductive segments 430 do not communicate with each other and such that segments in second number of conductive segments 434 do not communicate with each other. For example, insulating segments 438 may be positioned such that first number of conductive segments 430 and second number of conductive segments 434 are not adjacent to each other in these illustrative examples.

Of course, any number of inner and outer cylinders may be used. As another example, third cylinder 440 and fourth cylinder 442 also are present in cylindrical slip ring system 412. Third cylinder 440 is an example of an inner cylinder, while fourth cylinder 442 is an example of an outer cylinder. Third cylinder 440 has third number of conductive segments 444 located on outer surface 446 of third cylinder 440. Fourth cylinder 442 has fourth number of conductive segments 448 located on inner surface 450 of fourth cylinder 442.

Third cylinder 440 and fourth cylinder 442 both have axis of rotation 424. In other words, these cylinders are concentric with each other and with first cylinder 426 and second cylinder 428. Third cylinder 440 is located inside of fourth cylinder 442. First cylinder 426 and second cylinder 428 are located inside of third cylinder 440.

Third number of conductive segments 444 and fourth number of conductive segments 448 are arranged to conduct signals 414. Third number of conductive segments 444 is located such that third number of conductive segments 444 remains in communication with corresponding ones of fourth number of conductive segments 448. Insulating segments 438 also may be interspersed between third number of conductive segments 444 and fourth number of conductive segments 448.

In the different examples, first number of conductive segments 430 and second number of conductive segments 434 conducts first signals 449 in signals 414. Third number of conductive segments 444 and fourth number of conductive segments 448 conduct second signals 451 in signals 414.

In these illustrative examples, the different conductive segments may take various forms. For example, first number of conductive segments 430 may be number of raised edges 452, and second number of conductive segments 434 may be number of grooves 454. Insulating segments 438 may be an area interspersed between number of raised edges 452 and number of grooves 454. Number of raised edges 452 and number of grooves 454 may be plated to conductivity for electrical signals.

In yet other advantageous embodiments, instead of number of raised edges 452 and number of grooves 454, a combination of brushes and conductive surfaces may be used. For example, brushes may be used in place of number of raised edges 452. Those brushes may contact number of grooves 454. In yet other advantageous embodiments, a flat conductive surface may be used in place of number of grooves 454 when brushes are used. With optical signals, the conductive segments may be comprised of materials capable of transferring optical signals, such as those used in fiber optic cables.

In these illustrative examples, the different conductive segments may be connected to connectors 456. Connectors 456 may include electrical or optical lines that extend through the cylinders to provide connectors on the cylinders. For example, first number of connectors 458 may be connected to first number of conductive segments 430 at end 460 of first cylinder 426. Second number of conductive segments 434 is connected to second number of connectors 462 at end 464 of second cylinder 428. Third number of connectors 466 is connected to third number of conductive segments 444 at end 468 of third cylinder 440. Fourth number of connectors 470 is connected to fourth number of conductive segments 448 and is located at end 472 of fourth cylinder 442.

The illustration of signal transfer environment 400 in FIG. 4 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, only electrical signals may be conducted between structures 404 and 406. In yet other advantageous embodiments, optical signals may be transferred in addition to or in place of electrical signals. Further, in some advantageous embodiments, additional outer and inner cylinders may be present, depending on the particular implementation. Further, the conductive segments may take a number of different forms.

In other advantageous embodiments, platform 402 may take the form of, for example, without limitation, mobile platform, a stationary platform, a land-based structure, an aquatic-based structure, a space-based structure, an aircraft, a surface ship, a tank, a personnel carrier, a train, a space station, a satellite, a submarine, an automobile, a robot, or some other suitable type of platform.

Figure 5:
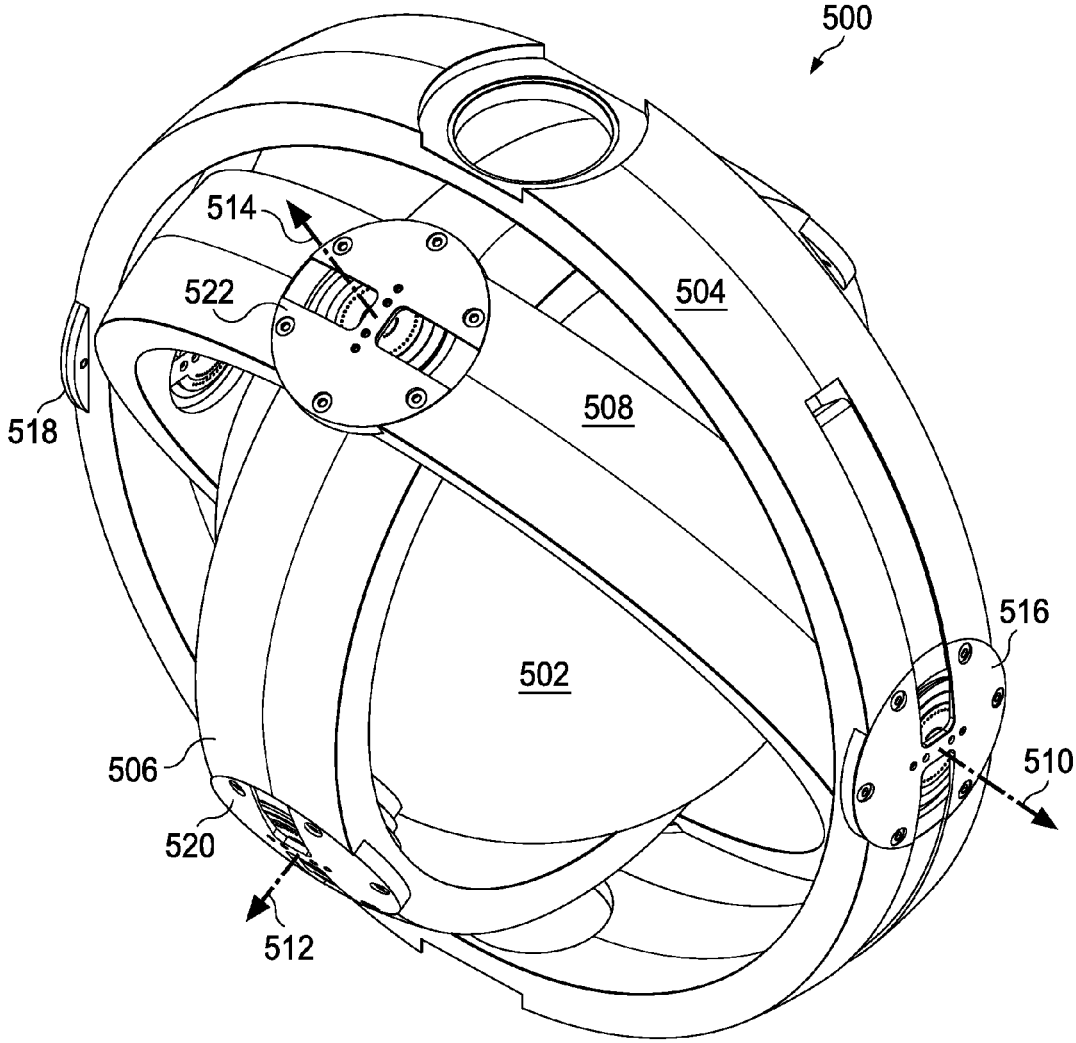
FIG. 5 is an illustration of a platform in accordance with an advantageous embodiment.

With reference now to FIG. 5, an illustration of a platform is depicted in accordance with an advantageous embodiment. In this illustrative example, a portion of platform 500 is depicted. Platform 500 may be, for example, without limitation, spacecraft 200 in FIG. 2, spacecraft 300 in FIG. 3, satellite 304 in FIG. 3, or some other suitable platform.

In this illustrative example, inertial measurement unit 502 is located within platform 500. Inertial measurement unit 502 is supported by structure 504, structure 506, and structure 508. These structures also may be referred to as gimbals.

Structure 504 rotates about axis 510. Structure 506 rotates about axis 512, and structure 508 rotates about axis 514. In this manner, inertial measurement unit 502 may rotate about three different axes.

Structure 504, structure 506, and structure 508 are connected to each other through joints. In this example, joints 516, 518, 520, and 522 are shown. Cylindrical slip ring system 412 in FIG. 4 may be implemented or associated with joints 516 and 518, in these examples, as described in more detail below.

Figure 6:
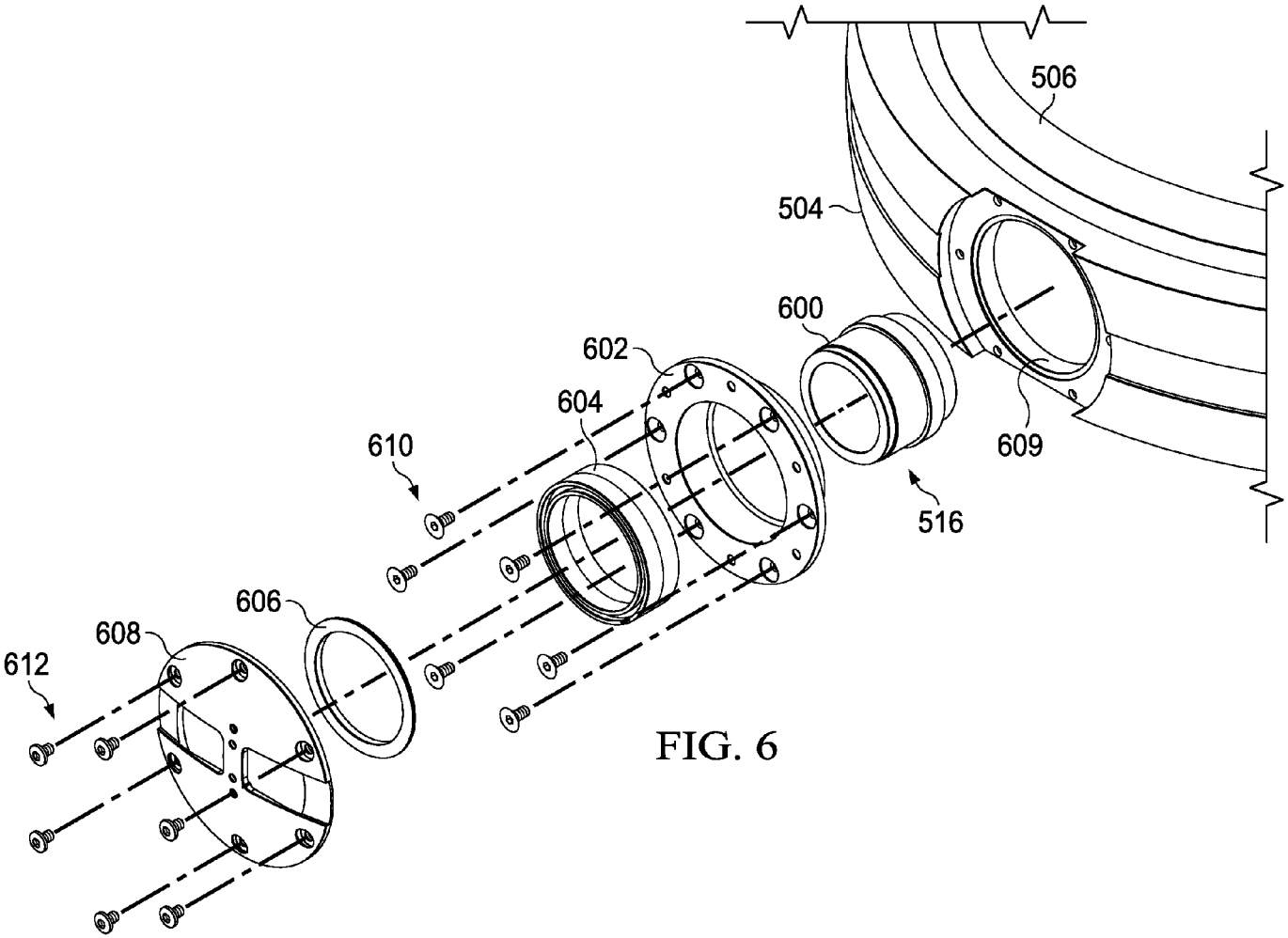
FIG. 6 is an illustration of an exploded view of a joint in accordance with an advantageous embodiment.

With reference now to FIG. 6, an illustration of an exploded view of a joint is depicted in accordance with an advantageous embodiment. In this example, joint 516 is shown in an exploded view with structure 504 and structure 506. In the different illustrative examples, a cylindrical slip ring system, such as cylindrical slip ring system 412 in FIG. 4, may be implemented inside of joint 516.

As illustrated, joint 516 comprises shaft 600, cartridge 602, bearing 604, inner race retainer 606, and outer race retainer 608. In this view, opening 609 is seen in structure 504 and structure 506. As illustrated, shaft 600 may be placed into opening 609 such that shaft 600 attaches to structure 506. Cartridge 602 is attached to structure 504. The inner diameter of bearing 604 is placed against the outer diameter of shaft 600. The outer diameter of bearing 604 fits onto the inner diameter of cartridge 602. Cartridge 602 is secured to structure 504 by fasteners 610. Inner race retainer 606 is screwed onto threaded portion of shaft 600. Outer race retainer 608 is secured to structure 504, in this example, by fasteners 612.

In these illustrative examples, the outer race of bearing 604 is attached to cartridge 602 and clamped by outer race retainer 608. The inner race of bearing 604 is clamped to shaft 600 by inner race retainer 606. In the depicted examples, shaft 600 can be thought of as part of structure 506, and likewise, cartridge 602 may be thought of as part of structure 504.

Figure 7:
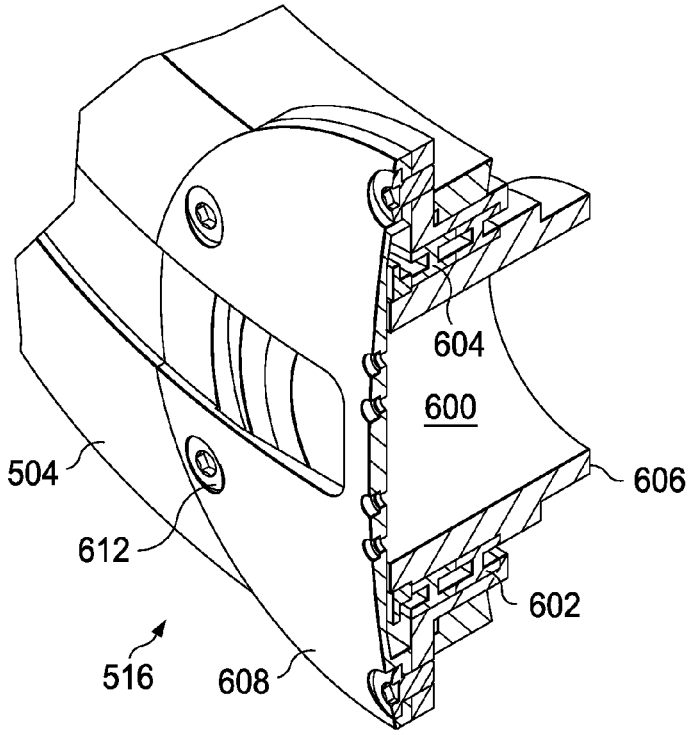
FIG. 7 is an illustration of an exposed assembled view of a joint in accordance with an advantageous embodiment.

With reference now to FIG. 7, an illustration of an exposed assembled view of a joint is depicted in accordance with an advantageous embodiment. In this example, a cross-sectional perspective view is depicted for joint 516 in an assembled form.

Figure 8:
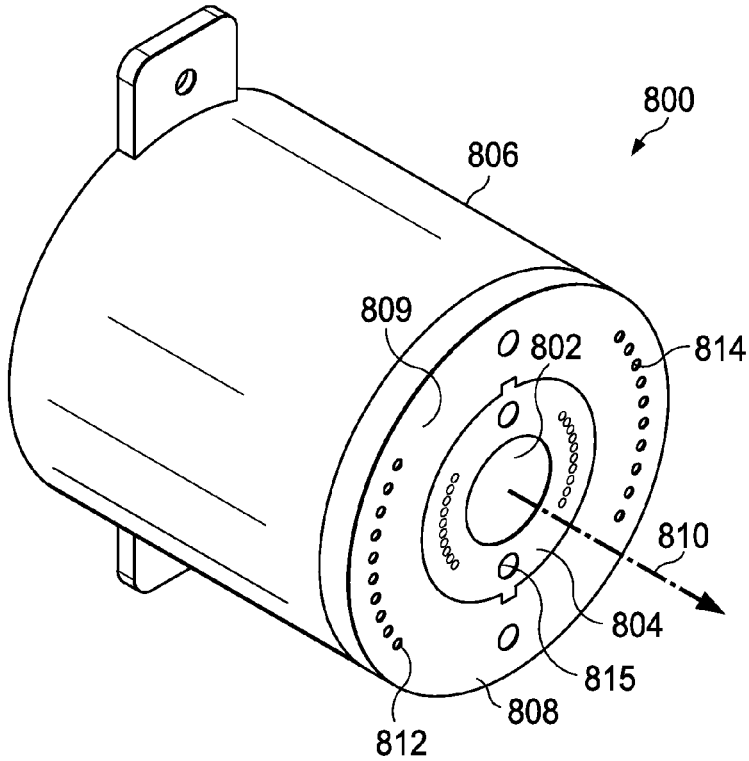
FIG. 8 is an illustration of a cylindrical slip ring system in accordance with an advantageous embodiment.

Turning now to FIG. 8, an illustration of a cylindrical slip ring system is depicted in accordance with an advantageous embodiment. In this illustrative example, cylindrical slip ring system 800 is illustrated with cylinders 802, 804, 806, and 808. These cylinders are located concentrically with each other. Further, these cylinders may rotate about axis 810, as indicated. Connectors 812 are illustrated on end 809 of cylinder 808, and connectors 814 are illustrated on end 815 of cylinder 804.

Figure 9:
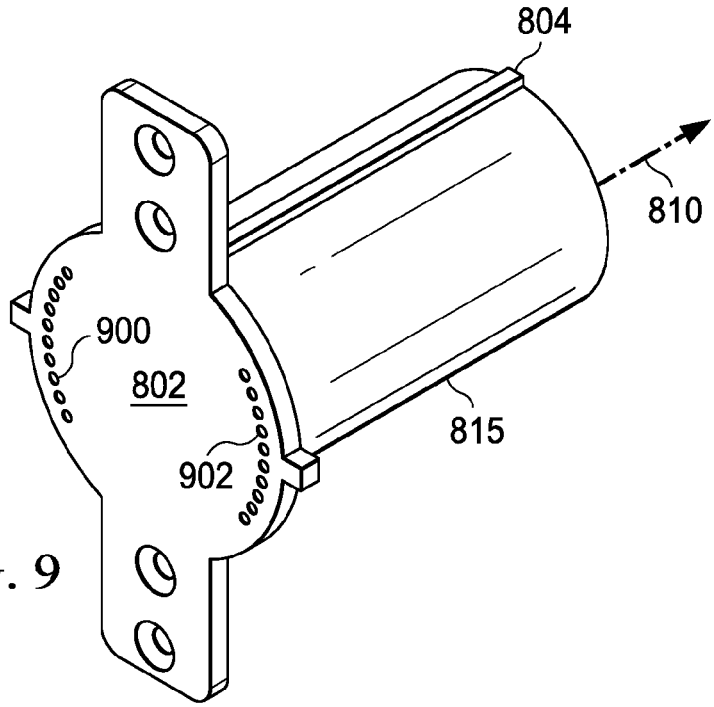
FIG. 9 is an illustration of a perspective view of a portion of a slip ring system in accordance with an advantageous embodiment.

Turning now to FIG. 9, an illustration of a perspective view of a portion of a slip ring system is depicted in accordance with an advantageous embodiment. In this view, connectors 900 are shown on end 902 of cylinder 802.

Figure 10:
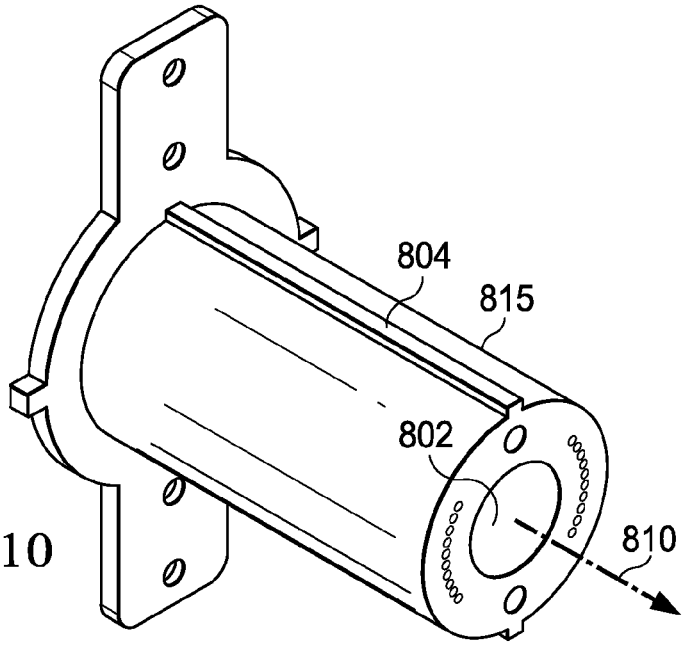
FIG. 10 is an illustration of another view of a portion of a cylindrical slip ring system in accordance with an advantageous embodiment.

With reference now to FIG. 10, an illustration of another view of a portion of a cylindrical slip ring system is depicted in accordance with an advantageous embodiment.

Figure 11:
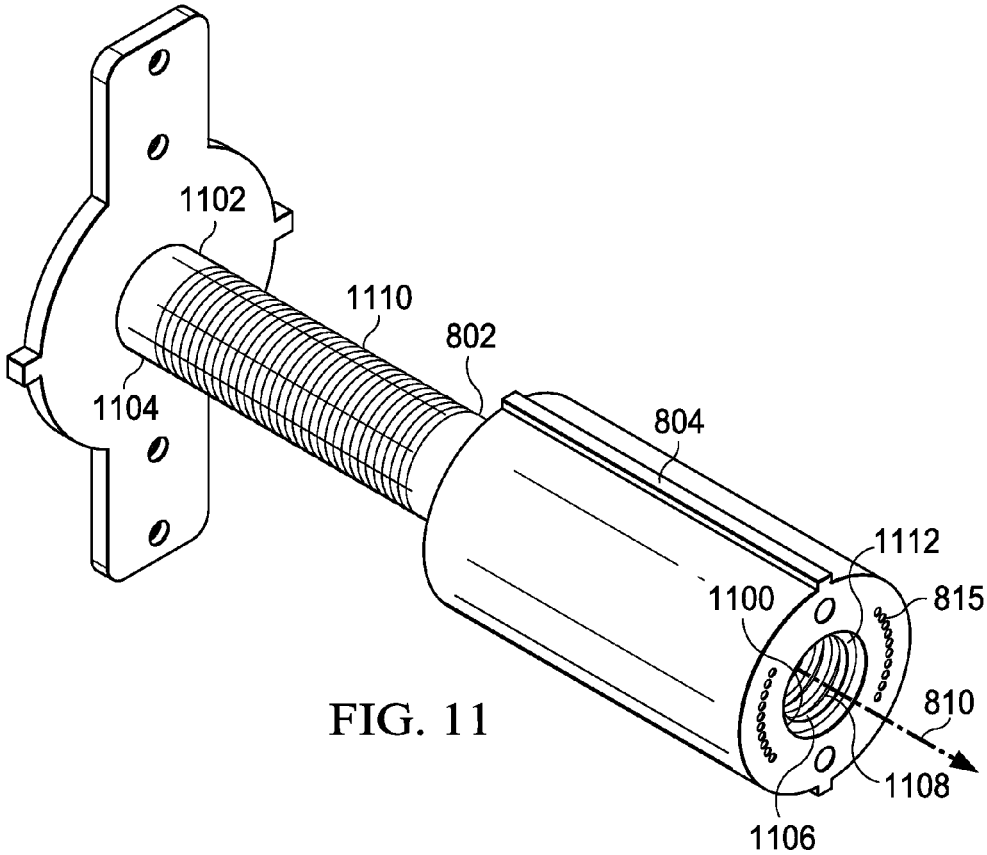
FIG. 11 is an illustration of an exploded view of a portion of a cylindrical slip ring system in accordance with an advantageous embodiment.

With reference now to FIG. 11, an illustration of an exploded view of a portion of a cylindrical slip ring system is depicted in accordance with an advantageous embodiment. In this example, an exploded view of cylinder 802 and cylinder 804 can be seen. Cylinder 802 is a solid cylinder, while cylinder 804 has channel 1100.

As illustrated, cylinder 802 has number of conductive segments 1102 on outer surface 1104 of cylinder 802. Cylinder 804 has number of conductive segments 1106 located on inner surface 1108 in channel 1100 in cylinder 804.

In these examples, insulating segments 1110 are interspersed between number of conductive segments 1102. In a similar fashion, insulating segments 1112 are present between number of conductive segments 1106. Number of conductive segments 1102 and number of conductive segments 1106 are configured such that corresponding conductive segments remain in communication with each other during rotation of cylinder 804 relative to cylinder 802.

Figure 12:
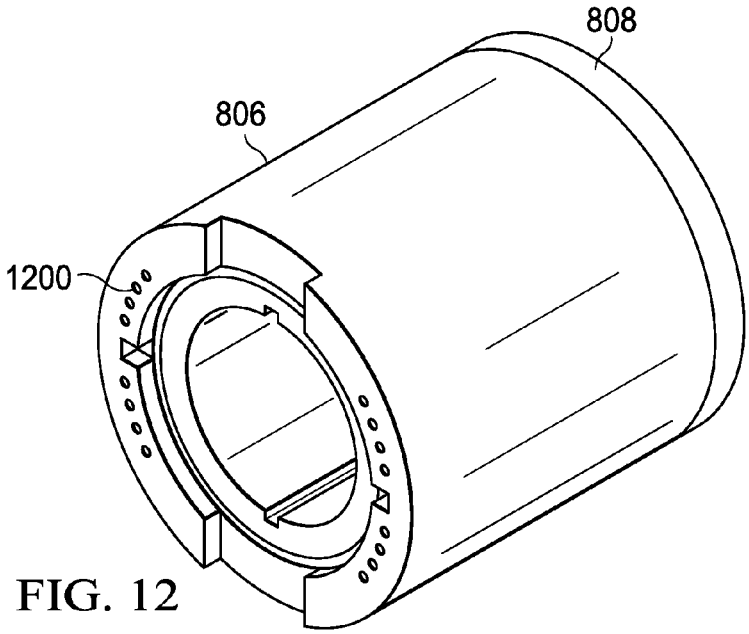
FIG. 12 is an illustration of a view of a portion of a cylindrical slip ring system in accordance with an advantageous embodiment.

With reference now to FIG. 12, an illustration of a view of a portion of a cylindrical slip ring system is depicted in accordance with an advantageous embodiment. Cylinder 806 is shown concentric with cylinder 808. In this example, cylinder 808 is located inside of cylinder 806. In this illustrative example, connectors 1200 are depicted for cylinder 806.

Figure 13:
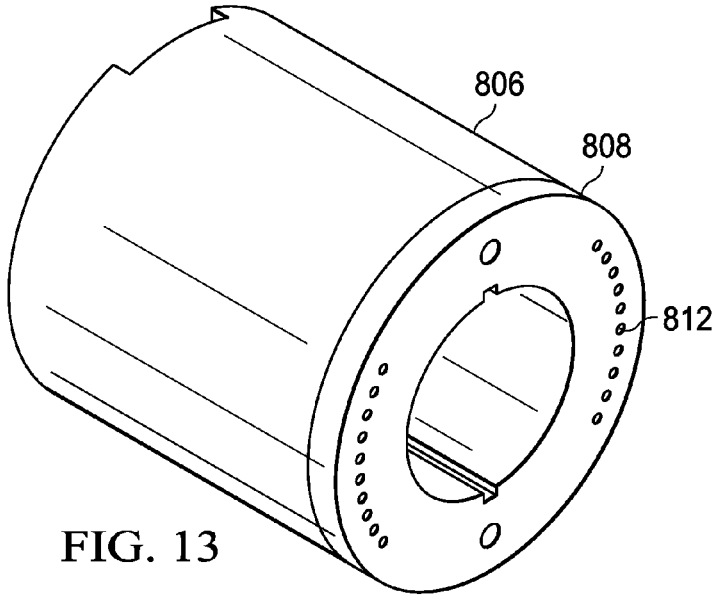
FIG. 13 is an illustration of another view of a portion of a cylindrical slip ring system in accordance with an advantageous embodiment.

In FIG. 13, an illustration of another view of a portion of a cylindrical slip ring system is depicted in accordance with an advantageous embodiment.

Figure 14:
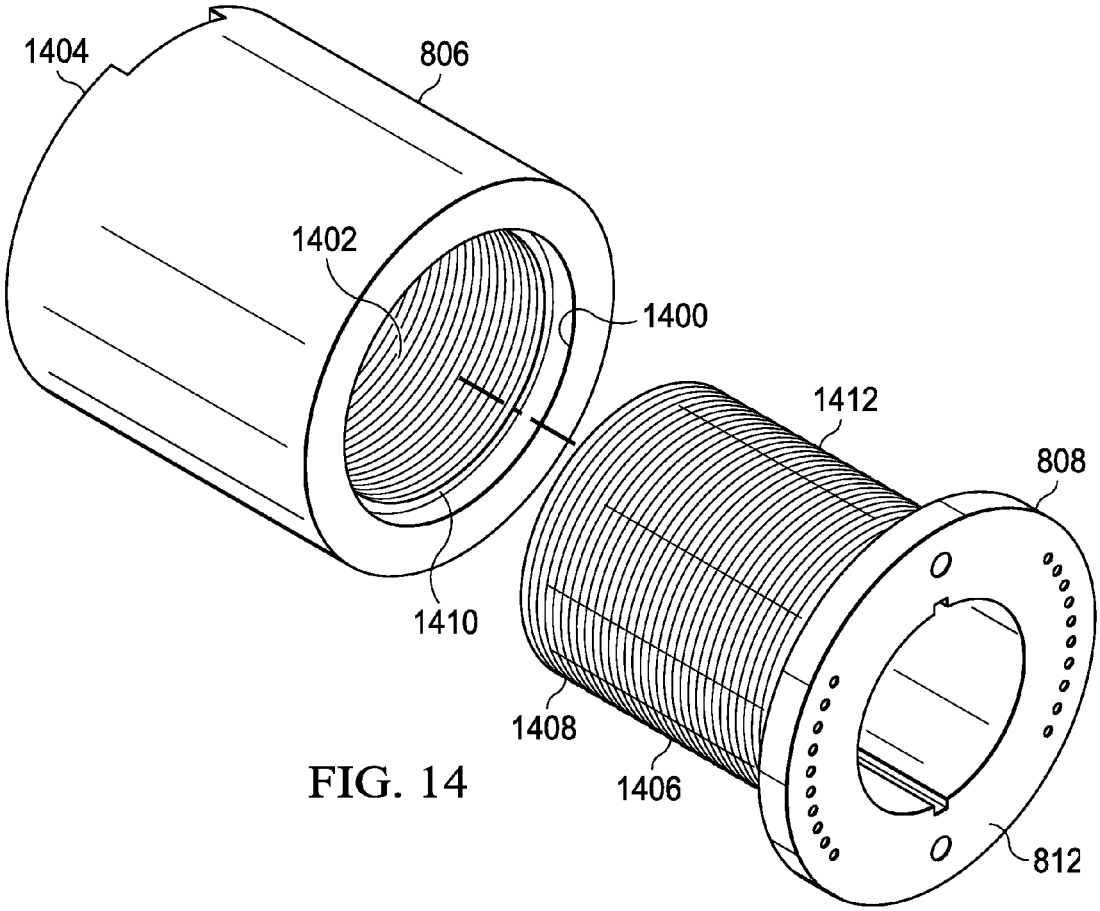
FIG. 14 is an illustration of an exploded view of a portion of a cylindrical slip ring system in accordance with an advantageous embodiment.

With reference now to FIG. 14, an illustration of an exploded view of a portion of a cylindrical slip ring system is depicted in accordance with an advantageous embodiment. In this exploded view, number of conductive segments 1400 are illustrated on inner surface 1402 of cylinder 806 in channel 1404. Number of conductive segments 1406 are seen on outer surface 1408 of cylinder 808. As can be seen, insulating segments 1410 are present between number of conductive segments 1400. In a similar fashion, insulating segments 1412 are interspersed between number of conductive segments 1406.

Figure 15:
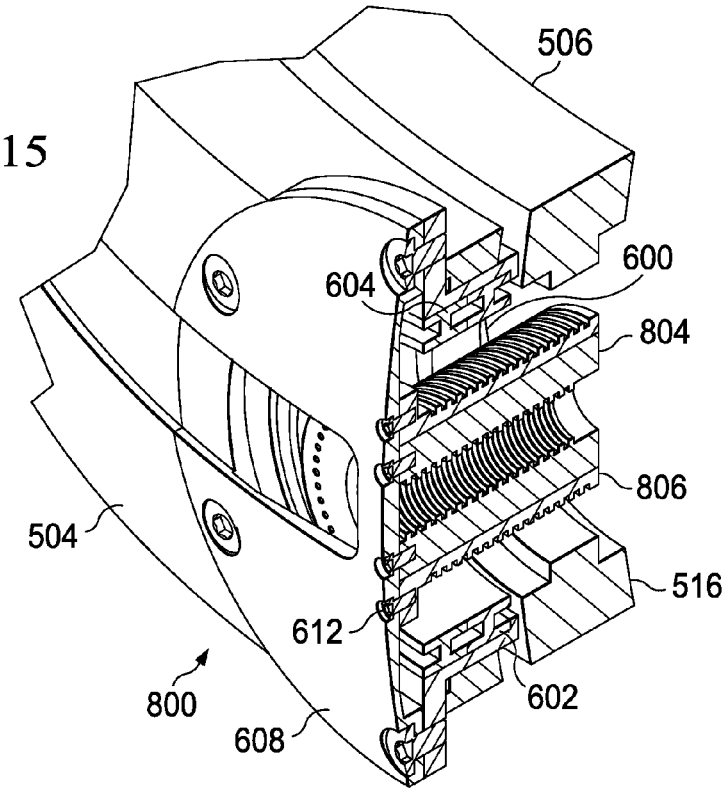
FIG. 15 is an illustration of a portion of a joint with a portion of a cylindrical slip ring system in accordance with an advantageous embodiment.

With reference now to FIG. 15, an illustration of a portion of a joint with a portion of a cylindrical slip ring system is depicted in accordance with an advantageous embodiment. A portion of joint 516 with a portion of cylindrical slip ring system 800 is shown in a cross-sectional perspective view. In this illustrative example, cylinder 806 and cylinder 804 in cylindrical slip ring system 800 are shown attached to structure 504.

Figure 16:
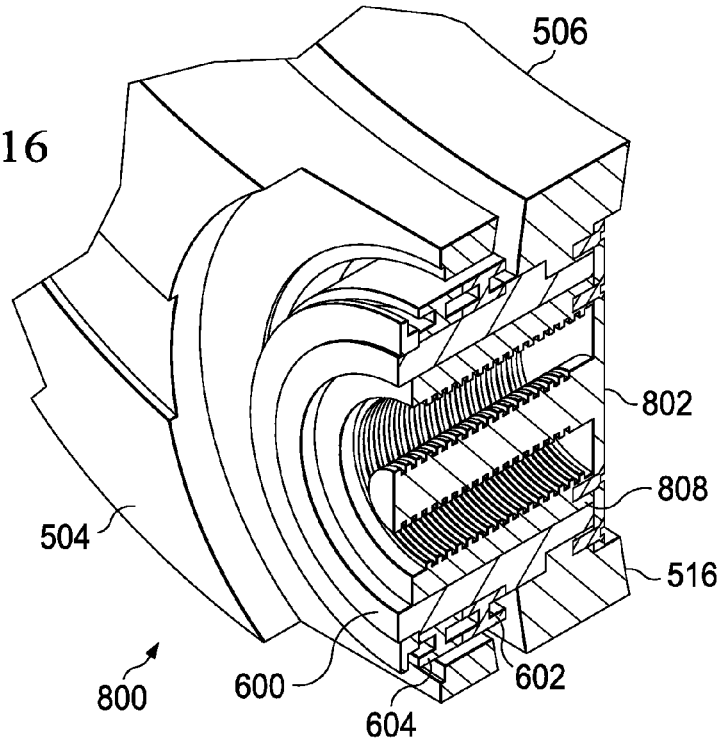
FIG. 16 is an illustration of a portion of a cylindrical slip ring system in a joint in accordance with an advantageous embodiment.

With reference now to FIG. 16, an illustration of a portion of a cylindrical slip ring system in a joint is depicted in accordance with an advantageous embodiment. In this partial cross-sectional view of joint 516 with another portion of cylindrical slip ring system 800, cylinder 802 and cylinder 808 in cylindrical slip ring system 800 are shown attached to structure 506.

Figure 17:
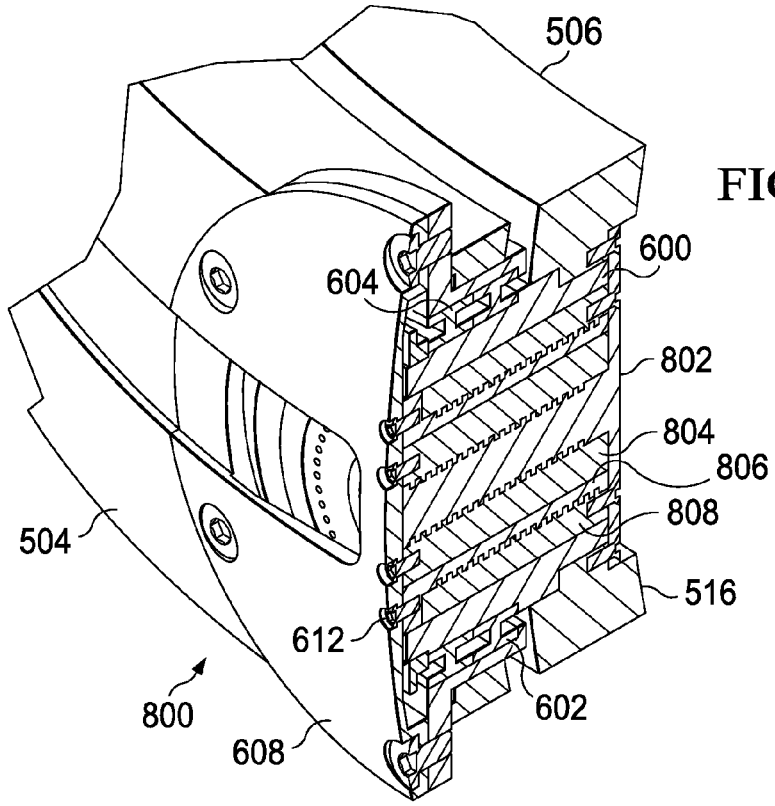
FIG. 17 is an illustration of a cross-sectional view of a slip ring system within a joint in accordance with an advantageous embodiment.

With reference now to FIG. 17, an illustration of a cross-sectional view of a slip ring system within a joint is depicted in accordance with an advantageous embodiment. In this example, cylindrical slip ring system 800 is shown as installed in joint 516.

Figure 18:
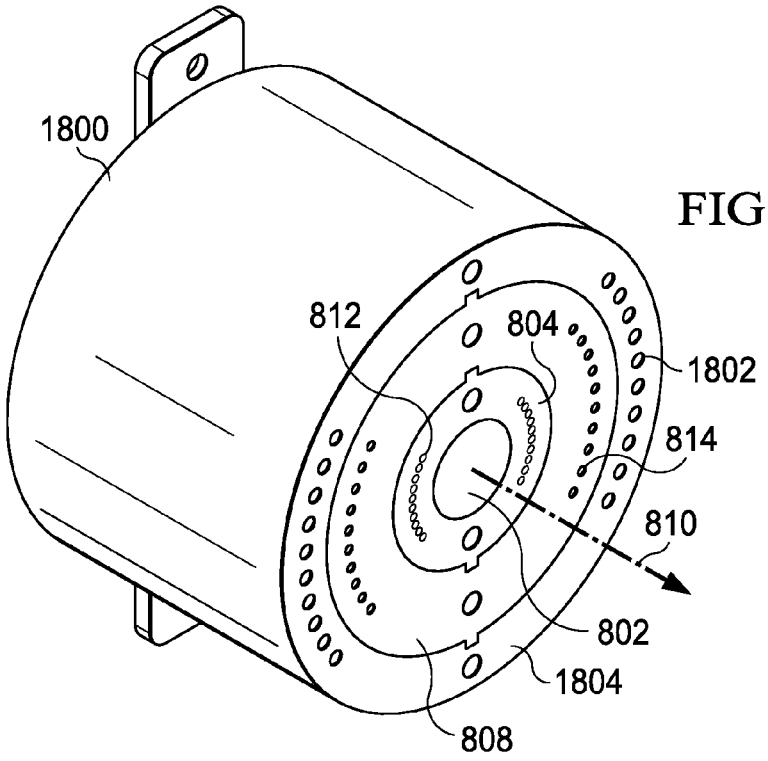
FIG. 18 is an illustration of a cylindrical slip ring system in accordance with an advantageous embodiment.

With reference now to FIG. 18, an illustration of a cylindrical slip ring system is depicted in accordance with an advantageous embodiment. In this illustrative example, cylinder 1800 is shown with two additional cylinders present, in which cylinder 1800 is seen in this perspective view. Connectors 1802 are present on end 1804 of cylinder 1800. As can be seen in these illustrative examples, cylinders 802, 804, and 808 are located within cylinder 1800.

Figure 19:
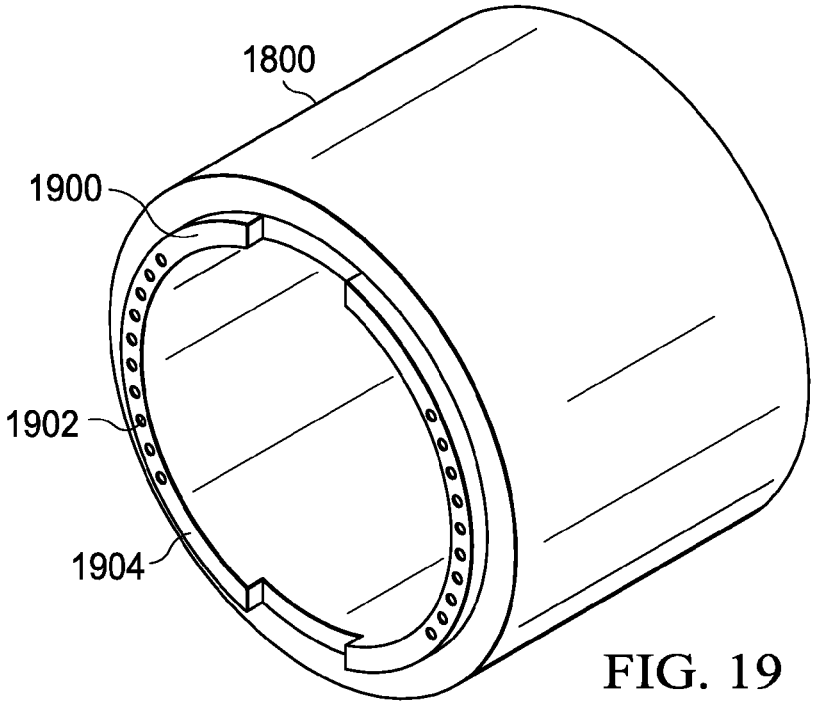
FIG. 19 is an illustration of another view of a portion of a cylindrical slip ring system in accordance with an advantageous embodiment.

With reference now to FIG. 19, an illustration of another view of a portion of a cylindrical slip ring system is depicted in accordance with an advantageous embodiment. In this view, cylinder 1800 is shown with cylinder 1900. In this example, connectors 1902 are seen on end 1904 of cylinder 1900. Cylinder 1900 is located within cylinder 1800. The other cylinders illustrated for cylindrical slip ring system 800 are located within these two cylinders.

Figure 20:
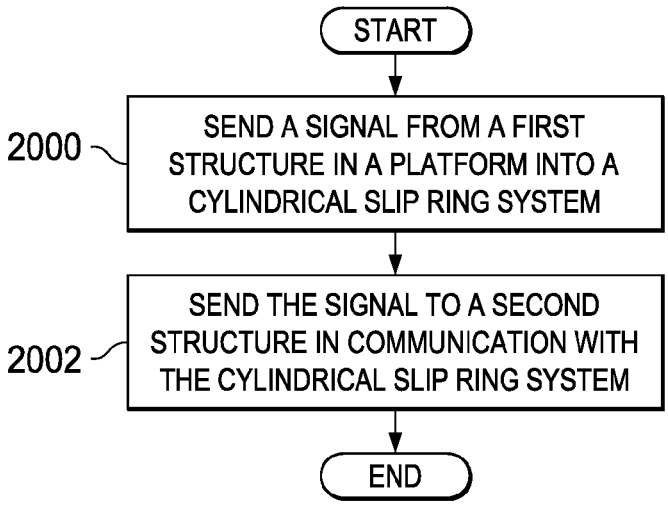
FIG. 20 is an illustration of a flowchart of a process for transmitting signals in accordance with an advantageous embodiment.

With reference now to FIG. 20, an illustration of a flowchart of a process for transmitting signals is depicted in accordance with an advantageous embodiment. The process illustrated in FIG. 20 may be implemented in signal transfer environment 400 in FIG. 4. In particular, this process may be performed using cylindrical slip ring system 412 in FIG. 4.

The process begins by sending a signal from a first structure in a platform into a cylindrical slip ring system (operation 2000). In response to receiving the signal from the first structure at the cylindrical slip ring system, the process sends the signal to a second structure in communication with the cylindrical slip ring system (operation 2002), with the process terminating thereafter. In these illustrative examples, the cylindrical slip ring system allows for a transfer of signals from the first structure to the second structure and from the second structure to the first structure, while the first structure and the second structure rotate with respect to each other. Further, these signals also may be sent between the structures while the structures are stationary with respect to each other.

The flowcharts and block diagrams in the different depicted embodiments illustrate the architecture, functionality, and operation of some possible implementations of apparatus and methods in different advantageous embodiments. In this regard, each block in the flowchart or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

Thus, the different advantageous embodiments provide a method and apparatus for transferring signals between structures in a platform. These signals may be transmitted between a first structure and a second structure in a platform that rotates with respect to each other.

With one or more of the different advantageous embodiments, additional numbers of signals may be transferred between a first structure and a second structure in a manner that reduces the length of the cylinders as compared to currently used devices. As more pairs of inner and outer cylinders are added, additional signals may be communicated without increasing the length of the cylindrical slip ring system. In other words, substantially the same number of signals may be transferred using a pair of inner and outer cylinders of a shorter length as compared to a single cylinder of a longer length. This type of cylindrical slip ring system may be used when space is limited on a particular platform.

The description of the different advantageous embodiments has been presented for purposes of illustration and description, and it is not intended to be exhaustive or limited to the embodiments in the form disclosed. Many modifications and variations will be apparent to those of ordinary skill in the art. Further, different advantageous embodiments may provide different advantages as compared to other advantageous embodiments.

The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a first cylinder having a first number of conductive segments located on an outer surface of the first cylinder, wherein the first number of conductive segments is configured to conduct first signals, and the first cylinder has an axis of rotation extending through the first cylinder;

a second cylinder having a second number of conductive segments located on an inner surface of the second cylinder, wherein the second number of conductive segments is configured to conduct the first signals, the second cylinder has the axis of rotation, and the first cylinder is located inside the second cylinder such that the first number of conductive segments remains in communication with corresponding ones of the second number of conductive segments during rotation of the first cylinder and the second cylinder relative to each other;

a third cylinder having a third number of conductive segments located on an outer surface of the third cylinder, wherein the third number of conductive segments is configured to conduct second signals, the third cylinder has the axis of rotation extending through the third cylinder, and the second cylinder is located inside of the third cylinder; and a fourth cylinder having a fourth number of conductive segments located on an inner surface of the fourth cylinder, wherein the fourth number of conductive segments is configured to conduct the second signals, the fourth cylinder has the axis of rotation, and the third cylinder is located inside the fourth cylinder such that the third number of conductive segments remains in communication with corresponding ones of the fourth number of conductive segments during rotation of the third cylinder and the fourth cylinder relative to each other.

2. The apparatus of claim 1, wherein the first number of conductive segments and the third number of conductive segments are ridges and the second number of conductive segments and the fourth number of conductive segments are grooves.

3. The apparatus of claim 1, wherein the first number of conductive segments and the third number of conductive segments are grooves and the second number of conductive segments and the fourth number of conductive segments are ridges.

4. The apparatus of claim 1, wherein the first number of conductive segments and the third number of conductive segments are conductive surfaces and the second number of conductive segments and the fourth number of conductive segments are brushes.

5. The apparatus of claim 1 further comprising:

insulating segments interspersed between the first number of conductive segments, the second number of conductive segments, the third number of conductive segments, and the fourth number of conductive segments.

6. The apparatus of claim 1 further comprising:

a first number of connectors connected to the first number of conductive segments, wherein the first number of connectors is located on an end of the first cylinder;

a second number of connectors connected to the second number of conductive segments, wherein the second number of connectors is located on an end of the second cylinder;

a third number of connectors connected to the third number of conductive segments, wherein the third number of connectors is located on an end of the third cylinder; and a fourth number of connectors connected to the fourth number of conductive segments, wherein the fourth number of connectors is located on an end of the fourth cylinder.

7. The apparatus of claim 1 further comprising:

a fifth cylinder having a fifth number of conductive segments located on an outer surface of the fifth cylinder in which the fifth number of conductive segments is configured to conduct third signals, the fifth cylinder having the axis of rotation extending through the fifth cylinder, and the fourth cylinder is located inside the fifth cylinder; and a sixth cylinder having a sixth number of conductive segments located on an inner surface of the sixth cylinder in which the sixth number of conductive segments is configured to conduct the third signals, wherein the sixth cylinder has the axis of rotation and the fifth cylinder is located inside the sixth cylinder such that corresponding ones of the fifth number of conductive segments remains in communication with corresponding ones of the sixth number of conductive segments during rotation of the fifth cylinder and the sixth cylinder relative to each other.

8. The apparatus of claim 1, wherein the first cylinder and the third cylinder are associated with a first structure in a platform, the second cylinder and the fourth cylinder are associated with a second structure in the platform, and the first structure and the second structure rotate relative to each other.

9. The apparatus of claim 8, wherein the first cylinder, the second cylinder, the third cylinder, and the fourth cylinder are part of a joint configured to moveably connect the first structure to the second structure.

10. The apparatus of claim 8, wherein the first structure is an inertial measurement unit and the second structure is a structure that supports the inertial measurement unit.

11. The apparatus of claim 8 further comprising:

the platform.

12. The apparatus of claim 8, wherein the platform is selected from one of a mobile platform, a stationary platform, a land-based structure, an aquatic-based structure, a space-based structure, an aircraft, a surface ship, a tank, a personnel carrier, a train, a spacecraft, a space station, a satellite, a submarine, an automobile, and a robot.

13. The apparatus of claim 1, wherein the first signals and the second signals are selected from at least one of electrical signals and optical signals.

14. An electrical signal connector system comprising:

a first cylinder having a first number of conductive segments located on an outer surface of the first cylinder and a first number of connectors electrically connected to the first number of conductive segments, wherein the first number of connectors is located on an end of the first cylinder, and the first number of conductive segments is configured to conduct first electrical signals;

a second cylinder having a second number of conductive segments located on an inner surface of the second cylinder and a second number of connectors electrically connected to the second number of conductive segments, wherein the second number of connectors is located on an end of the second cylinder, the second number of conductive segments is configured to conduct the first electrical signals, the first cylinder is located inside and concentric to the second cylinder such that corresponding ones of the first number of conductive segments remains in electrical contact with corresponding ones of the second number of conductive segments during rotation of the first cylinder and the second cylinder relative to each other;

a third cylinder having a third number of conductive segments located on an outer surface of the third cylinder and a third number of connectors electrically connected to the third number of conductive segments, wherein the third number of connectors is located on an end of the third cylinder, wherein the third number of conductive segments are configured to conduct second electrical signals, and the second cylinder is located inside and concentric to the third cylinder; and a fourth cylinder having a fourth number of conductive segments located on an inner surface of the fourth cylinder and a fourth number of connectors electrically connected to the fourth number of conductive segments, wherein the fourth number of connectors is located on an end of the fourth cylinder, and the fourth number of conductive segments is configured to conduct the second electrical signals, wherein the third cylinder is located inside and concentric to the fourth cylinder such that corresponding ones of the third number of conductive segments remains in electrical contact with corresponding ones of the fourth number of conductive segments during rotation of the third cylinder and the fourth cylinder relative to each other.

15. The electrical signal connector system of claim 14, wherein the first cylinder and the third cylinder are associated with a first structure in a platform, the second cylinder and the fourth cylinder are associated with a second structure in the platform, and the first structure and the second structure rotate relative to each other.

16. The electrical signal connector system of claim 15, wherein the first cylinder, the second cylinder, the third cylinder, and the fourth cylinder are part of a joint configured to moveably connect the first structure to the second structure.

17. The electrical signal connector system of claim 15, wherein the first structure is an inertial measurement unit and the second structure is a structure that supports the inertial measurement unit.

18. A method for transmitting signals, the method comprising:

sending the signals from a first structure in a platform into a cylindrical slip ring system comprising a first cylinder having a first number of conductive segments located on an outer surface of the first cylinder, wherein the first number of conductive segments is configured to conduct first signals, and the first cylinder has an axis of rotation extending through the first cylinder; a second cylinder having a second number of conductive segments located on an inner surface of the second cylinder, wherein the second number of conductive segments is configured to conduct the first signals, the second cylinder has the axis of rotation, and the first cylinder is located inside the second cylinder such that the first number of conductive segments remains in communication with corresponding ones of the second number of conductive segments during rotation of the first cylinder and the second cylinder relative to each other; a third cylinder having a third number of conductive segments located on an outer surface of the third cylinder, wherein the third number of conductive segments is configured to conduct second signals, the third cylinder has the axis of rotation extending through the third cylinder, and the second cylinder is located inside of the third cylinder; and a fourth cylinder having a fourth number of conductive segments located on an inner surface of the fourth cylinder, wherein the fourth number of conductive segments is configured to conduct the second signals, the fourth cylinder has the axis of rotation, and the third cylinder is located inside the fourth cylinder such that the third number of conductive segments remains in communication with corresponding ones of the fourth number of conductive segments during rotation of the third cylinder and the fourth cylinder relative to each other; and responsive to receiving the first signals from the first structure at the cylindrical slip ring system, sending the first signals to a second structure in communication with the cylindrical slip ring system.

19. The method of claim 18, wherein the first cylinder and the third cylinder are associated with the first structure in the platform, the second cylinder and the fourth cylinder are associated with the second structure in the platform, and the first structure and the second structure rotate relative to each other.

20. The method of claim 19, wherein the first cylinder, the second cylinder, the third cylinder, and the fourth cylinder are part of a joint configured to moveably connect the first structure to the second structure.

21. The method of claim 18, wherein the first signals and the second signals are selected from at least one of electrical signals and optical signals.

* * * * *